United States Patent [19]

McAuliffe, Jr. et al.

[11] Patent Number: 4,524,743

[45] Date of Patent: Jun. 25, 1985

[54] FUEL INJECTION APPARATUS AND SYSTEM

[75] Inventors: Lawrence McAuliffe, Jr., Warren; Richard Chauvin, Clawson, both of Mich.

[73] Assignee: Colt Industries Operating Corp., New York, N.Y.

[21] Appl. No.: 565,820

[22] Filed: Dec. 27, 1983

[51] Int. Cl.[3] ..... F02M 7/00

[52] U.S. Cl. ..... 123/438; 251/129; 251/141; 239/585; 123/472

[58] Field of Search ..... 123/472, 438, 440; 251/129, 141; 239/585

[56] References Cited

U.S. PATENT DOCUMENTS

| | | | |
|---|---|---|---|
| 4,218,021 | 8/1980 | Palma | 251/141 |
| 4,356,980 | 11/1982 | Krauss | 239/585 |
| 4,394,974 | 7/1983 | Saito et al. | 239/585 |
| 4,395,989 | 8/1983 | Eshelman et al. | 251/141 |
| 4,406,266 | 9/1983 | Kiesling | 123/438 |
| 4,421,278 | 12/1983 | Kienzle et al. | 239/585 |

FOREIGN PATENT DOCUMENTS

| | | | |
|---|---|---|---|
| 1157869 | 11/1963 | Fed. Rep. of Germany | 251/141 |
| 2315853 | 10/1973 | Fed. Rep. of Germany | 251/129 |

*Primary Examiner*—P. S. Lall

*Attorney, Agent, or Firm*—Walter Potoroka, Sr.

[57] ABSTRACT

A fuel metering apparatus is shown as having a throttle body with an induction passage therethrough and a throttle valve for controlling flow through the induction passage, a fuel-air mixture discharge member is situated generally in the induction passage downstream of the throttle valve, an air passage communicates between a source of air and the fuel-air mixture discharge member, the air passage is shown as also including a flow restrictor therein which provides for sonic flow therethrough, and a fuel metering valving assembly having a ball valve member is effective for metering liquid fuel as at a superatmospheric pressure and delivering such metered liquid fuel as into the air passage upstream of the flow restrictor thereby causing the thusly metered liquid fuel and air to pass through the sonic flow restrictor before being discharged into the induction passage by the fuel-air mixture discharge member, the ball valve member at least partly receives at least one resilient member which urges the ball valve member toward a seated condition.

10 Claims, 7 Drawing Figures

FUEL INJECTION APPARATUS AND SYSTEM

FIELD OF INVENTION

This invention relates generally to fuel injection systems and more particularly to fuel injection systems and apparatus for metering fuel flow to an associated combustion engine.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of government as being insufficient. Further, such levels of government have also arbitrarily imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, generally, the available technology employable in attempting to attain increases in engine fuel economy is contrary to that technology employable in attempting to meet the governmentally imposed standards on exhaust emissions.

For example, the prior art in attempting to meet the standards for $NO_x$ emissions has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for further burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofore proposed employing the retarding of the engine ignition timing as a further means for reducing the creation of $NO_x$. Also, lower engine compression ratios have been employed in order to lower the resulting combustion temperature within the engine combustion chamber and thereby reduce the creation of $NO_x$. In this connection the prior art has employed what is generally known as a dual bed catalyst. That is, a chemically reducing first catalyst is situated in the stream of exhaust gases at a location generally nearer the engine while a chemically oxidizing second catalyst is situated in the stream of exhaust gases at a location generally further away from the engine and downstream of the first catalyst. The relatively high concentrations of CO resulting from the overly rich fuel-air mixture are used as the reducing agent for $NO_x$ in the first catalyst while extra air supplied (as by an associated pump) to the stream of exhaust gases, at a location generally between the two catalysts, serves as the oxidizing agent in the second catalyst. Such systems have been found to have various objections in that, for example, they are comparatively very costly requiring additional conduitry, air pump means and an extra catalyst bed. Further, in such systems, there is a tendency to form ammonia which, in turn, may or may not be reconverted to $NO_x$ in the oxidizing catalyst bed.

The prior art has also proposed the use of fuel metering injection means for eliminating the usually employed carbureting apparatus and, under superatmospheric pressure, injecting the fuel through individual nozzles directly into the respective cylinders of a piston type internal combustion engine. Such fuel injection systems, besides being costly, have not proven to be generally successful in that the system is required to provide metered fuel flow over a very wide range of metered fuel flows. Generally, those prior art injection systems which are very accurate at one end of the required range of metered fuel flows, are relatively inaccurate at the opposite end of that same range of metered fuel flows. Also, those prior art injection systems which are made to be accurate in the mid-portion of the required range of metered fuel flows are usually relatively inaccurate at both ends of that same range. The use of feedback means for altering the metering characteristics of such prior art fuel injection systems has not solved the problem of inaccurate metering because the problem usually is intertwined within such factors as: effective aperture area of the injector nozzle; comparative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits.

The prior art, in view of such anticipated requirements, with respect to $NO_x$, has suggested the employment of a "three-way" catalyst, in a single bed, within the stream of exhaust gases as a means of attaining such anticipated exhaust emission limits. Generally, a "three-way" catalyst is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel) the $NO_x$ will be reduced effectively but the oxidation of CO will be incomplete; if the fuel metering is too lean, the CO will be effectively oxidized but the reduction of $NO_x$ will be incomplete. Obviously, in order to make such a "three-way" catalyst system operative, it is necessary to have very accurate control over the fuel metering function of the associated fuel metering supply means feeding the engine. As hereinbefore described, the prior art has suggested the use of fuel injection means, employing respective nozzles for each engine combustion chamber, with associated feedback means (responsive to selected indicia of engine operating conditions and parameters) intended to continously alter or modify the metering characteristics of the fuel injection means. However, as also hereinbefore indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means can never provide the degree of accuracy required in the metering of fuel to an associated engine as to assure meeting, for example, the said anticipated exhaust emission standards.

It has also heretofore been proposed to employ fuel injection type metering means wherein such metering means comprises solenoid valving means and more particularly valving means carried by the solenoid armature. Although this general type of metering means has proven to be effective in its metering function, the cost of producing such solenoid valving means has been generally prohibitive.

Further, various prior art structures have experienced problems in being able to supply metered fuel, at either a proper rate or in a proper manner, as to provide for a smooth engine and/or vehicle acceleration when such is demanded.

Accordingly, the invention as disclosed and described is directed, primarily to the solution of such and other related and attendant problems of the prior art.

SUMMARY OF THE INVENTION

According to the invention, a valving assembly for variably restricting fluid flow, comprising housing means, bobbin means situated in said housing means, said bobbin means comprising a generally medially situated tubular body portion, electrical field coil means carried by said bobbin means, pole-piece means situated generally within said tubular body portion, a valve seat member, fluid flow passage means formed through said valve seat member, said pole-piece means comprising a pole-piece face portion, a ball valve member situated generally between said face portion and said valve seat member, and resilient means normally resiliently urging said ball valve member toward operative seating engagement with said valve seat member as to thereby terminate flow through said fluid flow passage means, at least a portion of said resilient means being received within said ball valve member, said ball valve member forming the armature of said electrical coil and said pole-piece means.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted.

DETAILED DESCRIPTION OF THE PREFERRED EMBODIMENT

Figure 1:
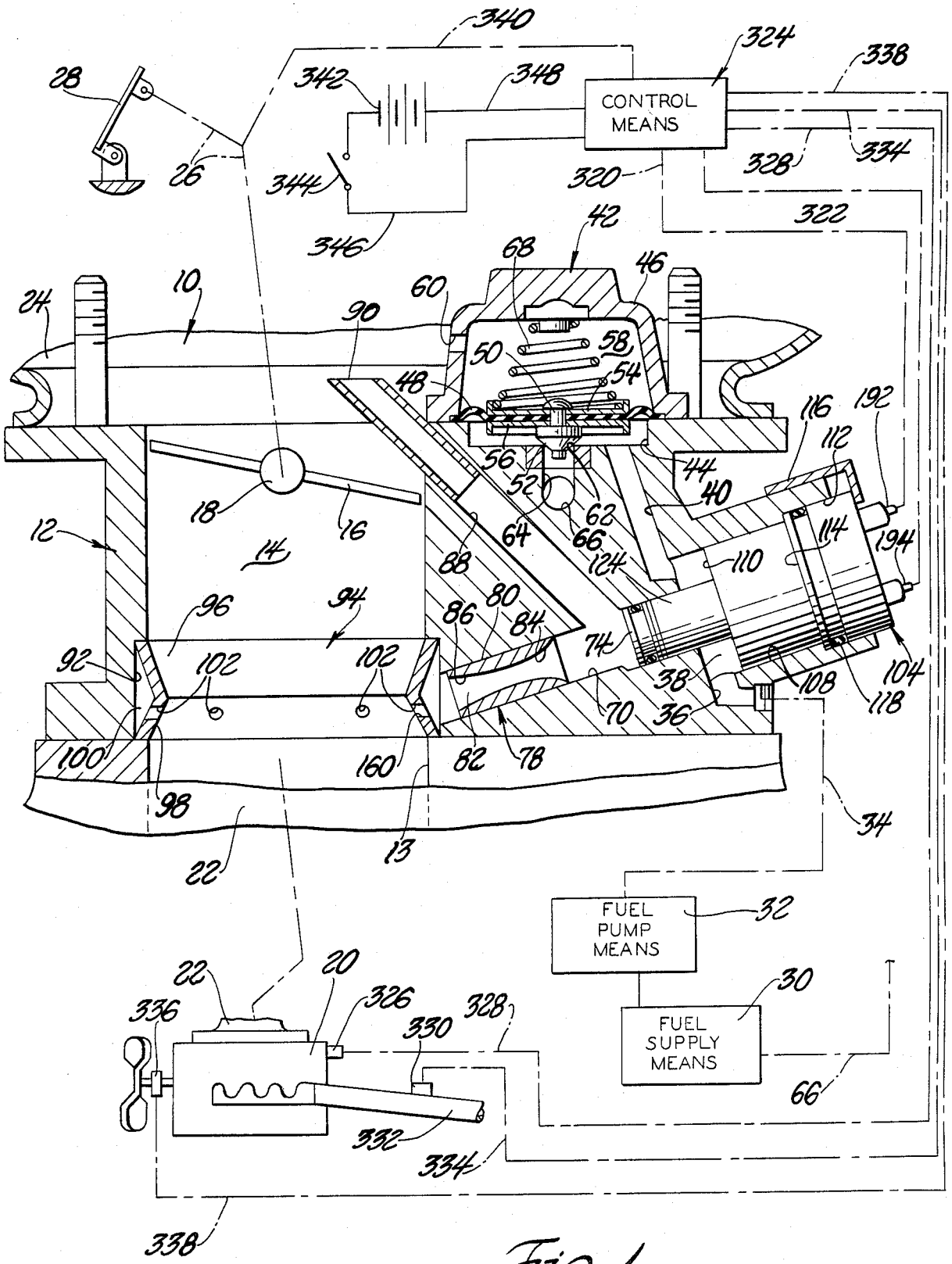
FIG. 1 illustrates, mostly in cross-section, a fuel injection apparatus and system employing teachings of the invention.
Figure 3:
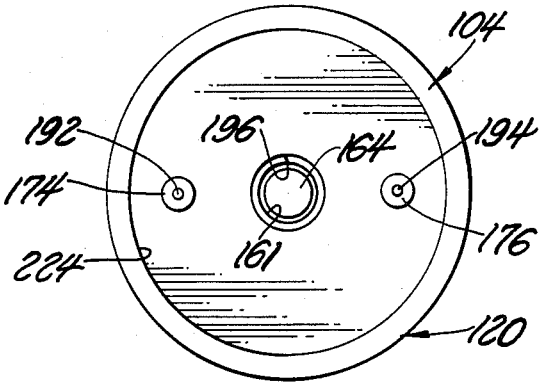
FIG. 3 is a view taken generally on the plane of line 3—3 of FIG. 2 and looking in the direction of the arrows.

Referring now in greater detail to the drawings, FIG. 1 illustrates fuel injection apparatus 10 and system comprised as of induction body or housing means 12 having induction passage means 14 wherein a throttle valve 16 is situated and carried as by a rotatable throttle shaft 18 for rotation therewith thereby variably restricting the flow of air through the induction passage means 14 and into the engine 20 as via associated engine intake manifold means 22. If desired suitable air cleaner means may be provided as to generally encompass the inlet of induction passage means 14 as generally fragmentarily depicted at 24. The throttle valve means 16 may be suitably operatively connected as through related linkage and motion transmitting means 26 to the operator positioned throttle control means which, as generally depicted, may be the operator foot-operated throttle pedal or lever 28 as usually provided in automotive vehicles.

A source of fuel as, for example, a vehicular gasoline tank 30, supplies fuel to associated fuel pumping means 32 which, in turn, delivers unmetered fuel as via conduit means 34 to conduit means 36 leading as to a chamber portion 38 which, in turn, communicates with passage or conduit means 40 leading to pressure regulator means 42. As generally depicted, the pressure regulator means 42 may comprise a recess or chamber like portion 44 formed in body 12 and a cup-like cover member 46. A deflectable diaphragm 48, operatively secured as to the stem portion 50 of a valving member 52 as through opposed diaphragm backing plates 54 and 56, is generally peripherally contained and retained between cooperating portions of body 12 and cover 46 as to thereby define variable and distinct chambers 44 and 58 with chamber 58 being vented as to a source of ambient atmospheric pressure as through vent or passage means 60. A valve seat or orifice member 62 cooperates with valving member 52 for controllably allowing flow of fuel therebetween and into passage means 64 and fuel return conduit means 66 which, as depicted, preferably returns the excess fuel to the fuel supply means 30. Spring means 68 situated as within chamber means 58 operatively engages diaphragm means 48 and resiliently urges valving member 52 closed against valve seat 62.

Generally, unmetered fuel may be provided to conduit means 36 and chamber 38 at a pressure of, for example, slightly in excess of 10.0 p.s.i. Passage 40 communicates such pressure to chamber 44 where acts against diaphragm 48 and spring means 68 which are selected as to open valving member 52 in order to thereby vent some of the fuel and pressure as to maintain an unmetered fuel pressure of 10.0 p.s.i.

Chamber 38 is, at times, placed in communication with metered fuel passage means 70 as through metered fuel orifice means 72 comprising, in the preferred embodiment of the invention, a portion of the overall fuel metering assembly 104 which, in FIG. 1 is shown in elevation and not in cross-section. Passage means 70 may also contain therein venturi means 78 which may take the form of an insert like member having a body 80 with a venturi passage 82 formed therethrough as to have a converging inlet or upstream surface portion 84 leading to a venturi throat from which a diffuser surface portion 86 extends downstream. A conduit 88 shown as having one end 90 communicating as with a source of ambient atmosphere has its other end communicating with metered fuel passage means 70 as at a point or area upstream of venturi restriction means 78 and, generally, downstream of metered fuel passage means 72.

A counterbore or annular recess 92 in body means 12 is illustrated as closely receiving therein an annular or ring-like member 94 which may have an upper or upstream annular body portion 96 which converges and a lower or downstream annular body portion 98 which diverges. The coacting converging and diverging wall portions of annular member 94, in turn, cooperate with recess 92 to define therebetween an annulus or annular space 100 which communicates with metered fuel passage means 70 and the downstream or outlet end of restriction means 78. A plurality of discharge orifice means 102 may be formed, in angularly spaced relationship, in annular member 94 as to be generally circumferentially thereabout. Further, such discharge orifice means may be formed in the downstream diverging portion 98 as to be at or below the general area of juncture between upstream and downstream annular portions 96 and 98. Of such discharge orifice means 102, one orifice means, as designated at 160, may be formed as to be in general alignment with the discharge axis of restriction means 78.

Passage 72 is formed through a valve seat member 74 preferably operatively carried by an oscillator type valving means or assembly 104. The metering assembly 104 is illustrated in FIG. 1 as being closely received within a bore 108 in body means 12 as to result in face-like portion 110 forming a portion of the wall means defining chamber 38. A counterbore 112, forming an annular shoulder, serves to receive the larger portion of the assembly 104 and a flange portion 114 of the assembly 104 abuts against such shoulder while suitable clamping means 116 serves to hold the assembly 104 against the shoulder of counterbore 112. An annular seal, such as, for example, an O-ring 118 serves to prevent fuel leakage from chamber 38 past the assembly 104.

Figure 4:
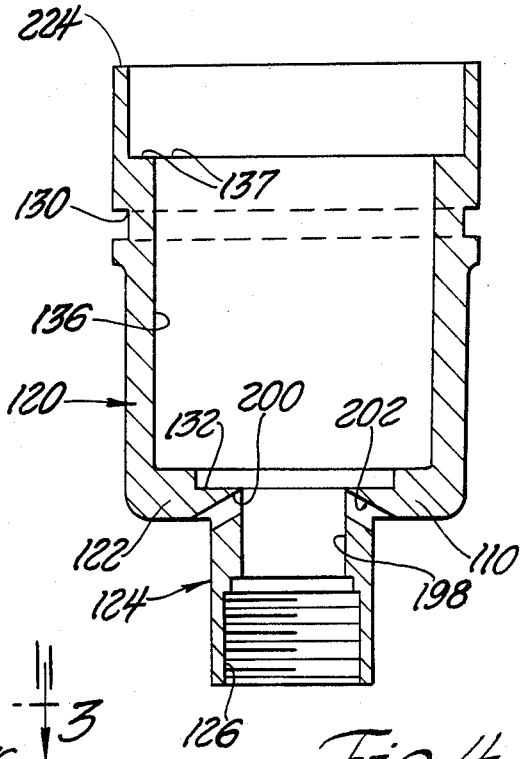
FIG. 4 is an axial cross-sectional view of one of the elements shown in FIG. 2.
Figure 2:
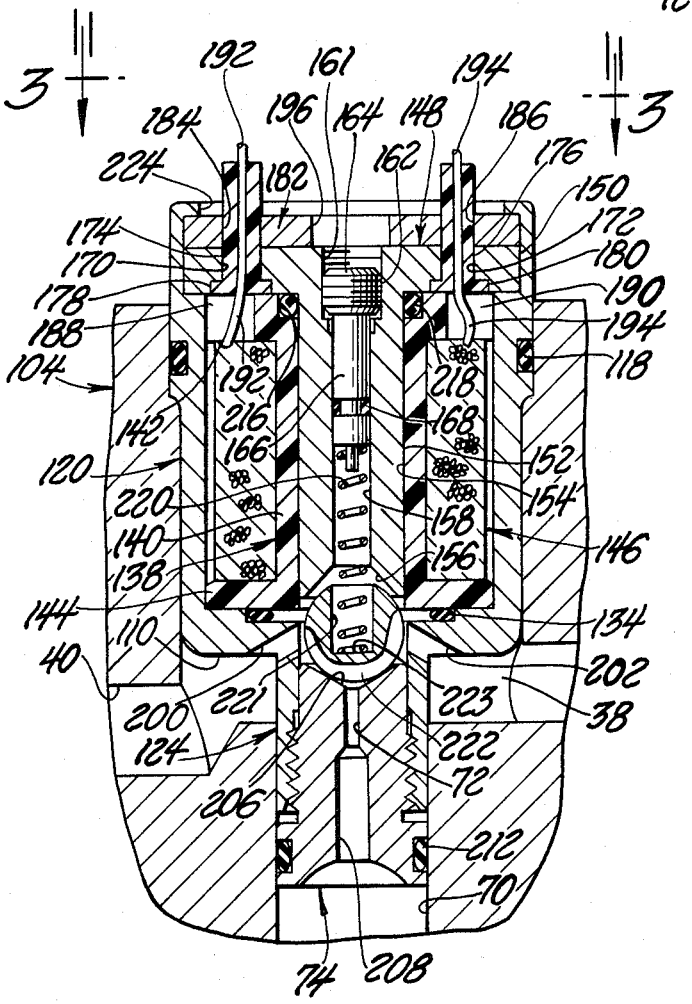
FIG. 2 is a relatively enlarged axial cross-sectional view of the metering valve assembly of FIG. 1.

Referring now also to FIGS. 2 and 4, the metering valving means 104 is illustrated as comprising a generally tubular outer housing 120 having a lower (as viewed in FIGS. 2 and 4) end wall 122 the outer surface of which defines said face 110. A generally tubular extension 124 is preferably formed integrally with end wall 122 and internally threaded as at 126 in order to threadably engage an externally threaded portion 128 of the valve seat member 74. The housing 120 is provided with a circumferential groove 130 for the reception of annular seal 118. Preferably, the inner surface of lower end wall is provided with an annular stepped (or the like) surface 132 for the reception of a suitable sealing means such as, for example, an O-ring 134.

The cylindrical inner surface 136 of housing 120 closely receives bobbin means 138 which, in FIG. 2, is illustrated as comprising a generally tubular body portion 140 with integrally formed radially extending annular flange or wall portions 142 and 144 at opposite ends thereof. An electrical coil or winding 146 is carried generally about bobbin tubular body 140 and situated axially between flange wall portions 142 and 144.

A pole piece or core means 148 is depicted as comprising a disc-like body portion 150 and an integrally formed cylindrical extension 152 which is closely received within the inner cylindrical surface 154 of bobbin tubular body portion 140. The pole piece end face is formed as to have a 90° or even larger included conical surface portion 156 which, in effect, meets with an axial passageway 158. The configuration of such pole face means 156 may be any suitable configuration and, in fact, may be one of generally spherical contour. The upper (as viewed in FIG. 2) end of passageway 158 is threaded as at 161 in order to threadably coact with an externally threaded portion 162 of a body section 164 which may be integrally formed with a cylindrical extension 166. The extension 166 is preferably provided with a circumferential groove for the reception of suitable sealing means such as, for example, an O-ring 168.

The disc body 150 of pole piece 148 is provided with passage means 170 and 172 for the respective reception of tubular dielectric members 174 and 176, which may have respective annular flanges 178 and 180. Similarly, a disc-like end cover or capping member 182 is provided with passages 184 and 186 for the respective reception of dielectric members 174 and 176. Upper (as viewed in FIG. 2) flange 142 of bobbin means 138 is formed with slots or cut-out portions 188 and 190 for the reception therethrough of the ends or leads 192 and 194 of coil means 146. Such electrical conductors 192 and 194, respectively, pass through dielectric members 174 and 176. Cover member 182 is also preferably provided with a clearance or access aperture 196.

As seen in both FIGS. 2 and 4, wall portion 122 and extension 124 have a cylindrical passageway 198 formed therethrough and a plurality of inlet passageways or conduits 200 and 202 are formed generally through wall 122 and extension 124.

Figure 5:
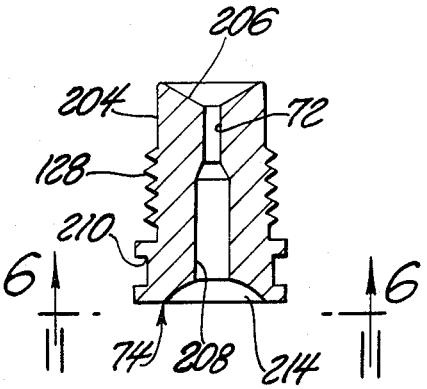
FIG. 5 is an axial cross-sectional view of another element shown in FIG. 2.
Figure 6:
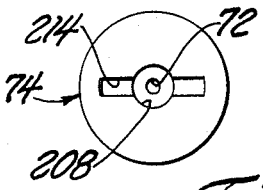
FIG. 6 is a view taken generally on the plane of line 6—6 of FIG. 5 and looking in the direction of the arrows.

As best seen in FIG. 5, the outer diameter 204 of valve seat member 74 is preferably a size as to be closely received by pilot diameter or surface 198 of extension 124. Further, the valve seating surface 206 is formed as to be substantially concentric with outer diameter surface 204. Although other configurations are possible, in the preferred form the seating surface 206 is of conical configuration.

Passage 72 is shown in communication with a generally enlarged conduit or passage portion 208 which, in turn, as shown in each of FIGS. 1 and 2, communicates metered fuel passage means 70. The lower portion (as viewed in FIGS. 2 and 5) is provided with a circumferential groove 210 which receives suitable sealing means such as, for example, an O-ring 212 so that upon assembly of the overall assembly 104 to the body means 12, such seal 212 prevents any leakage flow from chamber 38 to the metered fuel conduit or passage means 70. The lower-most end of valve seat member 74 is preferably provided with a slot-like recess 214 serving as tool-engaging surface means.

An annular groove or recess 216 formed in the upper end of bobbin tubular body 140 is suited for the reception of suitable sealing means such as, for example, an O-ring 218.

A compression spring 220 received within passageway 158 is seated at its one end against the end of axially adjustable extension (spring seat) 166. The opposite end of spring 220 is operatively received within recess or pocket-like means 221 formed in a ball valve 222. In the preferred embodiment the end surface means 223 of recess or chamber means 221 is formed as to be effectively, as viewed in FIG. 2, below the center of rotation of said ball valve 222. The resilient means 220, of which there may be more than one, thusly engages the armature-ball valve member 222 and resiliently urges such valve member 222 into seated sealing engagement with valve seat member 74 seating surface 206.

The following may be the method and manner of assembling the various details, subassemblies and/or elements. First, the sealing means 134 is placed as onto surface 132 and this is followed by placing the bobbin-coil assembly into housing 120 compressing sealing means 134. Next, the electrical leads 192 and 194 may be respectively drawn through the dielectric members 174 and 176 and then such dielectric members may be inserted through passages 170 and 172 of pole piece or core means 148. Next, the annular sealing means 218 may be placed generally into recess 216 and then the pole piece means 148, with the adjustable spring seat means 164, 166 therein, may be placed within housing 120, thereby axially containing the bobbin 138, and abutted against the inner annular shoulder 137 of housing 120. Following this, the dielectric members 170 and 172 (with conductors 192 and 194 therein) may be inserted through passages 184 and 186 of cover or end member 182 and such member 182 then seated against the disc body 150 of pole piece means 148. The upper end 224 of housing 120 is then suitably formed over the end member 182 as to maintain the described assembled elements in assembled relationship as generally depicted in FIG. 2.

Following the above, the spring 220 is inserted, through passageway 198, into passageway or clearance 158 and the ball armature 222 is then placed generally within passageway 198 as to at least partially receive and be against the spring 220. The valve seat member 74 is then threadably engaged with the threaded extension 124 of housing 120.

Once the various elements are thusly assembled, calibration of the assembly 104 is undertaken. In such calibration, the valve seat member 74 is threadably rotated axially inwardly until the armature 222, pushed against the resilient resistance of spring 220 by the valve seat member 74, becomes seated against the surface 156 of pole piece 148. Following this, the valve seat member 74 is threadably rotated in the opposite direction, causing outward axial movement thereof, until the valve seat member 74 has moved axially outwardly (downwardly as viewed in FIG. 2) a preselected distance as, for example, 0.005 inch. Since spring 220 is constantly resiliently urging armature 222 away from the pole piece face 156, armature 222 will have moved a corresponding distance away from the pole piece face 156 which, in this case, is assumed as being 0.005 inch.

At this time the valve seat member 74 is preferably suitably fixed to the extension 124 as to prevent any further relative threadable rotation of the valve seat member 74.

The assembly 104 is then placed into a test stand and the coil 146 pulsed at a preselected frequency and a preselected pulse width while fluid under a preselected pressure (assumed to be, for example, 10.0 p.s.i.) is flowed into ports 200 and 202 of extension 124. At this point it should be made clear that even though ball 222 has heretofore been referred to as an armature, it also functions as a valve member. With every pulsed energization of coil means 146, armature-valve 222 is drawn upwardly (as viewed in FIG. 2) against the pole piece face 156 thereby opening valve seat member 74 passage 72 to flow therethrough. The rate of flow of such pressurized fluid (during the pulsing of the coil means 146) through the inlet port means 200 and 202 and out of passage 208 is measured and if the rate of fluid flow is, for example, less than a preselected magnitude of rate of flow screw 164 which may have an allen head, is adjusted upwardly to thereby lessen the preload of spring 202 which, consequently, has the ultimate effect of increasing the rate of fluid flow through passages 72 and 146 without changing the pulse frequency or duration. Of course, such upward movement of spring perch 164, 166 is continued until the desired rate of fluid flow through passages 72 and 208 is achieved at which time the adjustable spring perch 164, 166 is preferably prevented from further unauthorized adjustment.

If, instead, it is found that the rate of fluid flow is, for example, more than a preselected magnitude of rate of flow, the allen head spring perch 164, 166 is adjusted in such a direction as to cause an increase in the preload of spring 220 which, consequently, has the ultimate effect of decreasing the rate of fluid flow through passages 72 and 208 without changing the pulse frequency or duration. Of course, such downward movement of spring perch means 164, 166 is continued until the desired rate of fluid flow through passages 72 and 208 is achieved at which time the adjustable spring perch means 164, 166 is preferably prevented from further unauthorized adjustment. After such calibration, the metering means 104 may be assembled as to associated induction means 10 as generally depicted in FIG. 1. Terminal means 192 and 194 may be respectively electrically connected as via conductor means 320 and 322 to related control means 324. As should already be apparent, the metering means 104 is of the duty cycle type wherein the winding or coil means 146 is intermittently energized thereby causing, during such energization, valve member 222 to move in a direction away from valve seat member 74. Consequently, the effective flow area of valve orifice or passage 72 can be variably and controllably determined by controlling the frequency and/or duration of the energization of coil means 146.

The control means 324 may comprise, for example, suitable electronic logic type control and power outlet means effective to receive one or more parameter type input signals and in response thereto produce related outputs. For example, engine temperature responsive transducer means 326 may provide a signal via transmission means 328 to control means 324 indicative of the engine temperature; sensor means 330 may sense the relative oxygen content of the engine exhaust gases (as within engine exhaust conduit means 332) and provide a signal indicative thereof via transmission means 334 to control means 324; engine speed responsive transducer means 336 may provide a signal indicative of engine speed via transmission means 338 to control means 324 while engine load, as indicated for example by throttle valve 16 position, may provide a signal as via transmission means 340 to control means 324. A source of electrical potential 342 along with related switch means 344 may be electrically connected as by conductor means 346 and 348 to control means 324.

OPERATION OF INVENTION

Generally, in the embodiment disclosed, fuel under pressure is supplied as by fuel pump means 32 to conduit 36 and chamber 38 (and regulated as to its pressure by regulator means 42) and such fuel is metered through the effective metering area of valve orifice means 72 to conduit portion 70 from where such metered fuel flows through restriction means 78 and into annulus 100 and ultimately through discharge port means 102 and to the engine 20. The rate of metered fuel flow, in the embodiment disclosed, will be dependent upon the relative percentage of time, during an arbitrary cycle time or elapsed time, that the valve member 222 is relatively close to or seated against orifice seat member 74 as compared to the percentage of time that the valve member 222 is relatively far away from the cooperating valve seat member 74.

This is dependent on the output to coil means 146 from control means 324 which, in turn, is dependent on the various parameter signals received by the control means 324. For example, if the oxygen sensor and transducer means 330 senses the need of a further fuel enrichment in the motive fluid being supplied to the engine and transmits a signal reflective thereof to the control means 324, the control means 324, in turn, will require that the metering valve 222 be opened a greater percentage of time as to provide the necessary increased rate of metered fuel flow. Accordingly, it will be understood that given any selected parameters and/or indicia of engine operation and/or ambient conditions, the control means 324 will respond to the signals generated thereby and respond as by providing appropriate energization and de-energization of coil means 146 (causing corresponding movement of valve member 222) thereby achieving the then required metered rate of fuel flow to the engine.

The prior art has employed relatively high pressures both upstream and downstream of the fuel metering means in an attempt to obtain sufficient fuel atomization within the induction passage means. Such have not proven to be successful.

It has been discovered that the invention provides excellent fuel atomization characteristics even when the upstream unmetered fuel pressure is in the order of 10.0 p.s.i. (the prior art often employing upstream unmetered fuel pressures in the order of 40.0 p.s.i.).

That is, within the environment of the embodiment or assembly illustrated, conduit means 88 supplies at least most of the air needed to sustain idle engine operation when the throttle valve means 16 is closed. As can be seen a flow circuit is described by inlet 90 of conduit 88, conduit 88, passage means 70, passage means 82, annulus 100, orifice means 102 and engine intake manifold induction passage means 13; such, in the depicted embodiment, provides all of the air flow to the engine 20 required for idle engine operation. The restriction means 78 is of a size as to result in the flow through passage 82 being sonic during idle engine operation. The fuel which is metered by valve member 74 and injected into passage 70 mixes with the air as the metered fuel and air flow into inlet 84 of venturi nozzle-like means 78 and become accelerated to sonic velocity. The fuel within such fuel-air mixtures becomes atomized as it undergoes acceleration to sonic velocity and subsequent expansion in portion 86 of venturi means 78. The atomized fuel-air mixture then passes into annulus 100 and is discharged, generally circumferentially of induction passage means 14, through the discharge port means 102 of diffuser means 94 and into passage means 13 of engine 20. In the depicted embodiment, the restriction means 78 not only provides for sonic flow therethrough during idle engine operation but also provides for sonic flow therethrough during conditions of engine operation other than idle and, preferably, over at least most of the entire range of engine operation.

When further engine power is required, throttle valve means 16 is opened to an appropriate degree and the various related parameter sensing means create input signals to control means 324 resulting in fuel metering means 104 providing the corresponding increase in the rate of metered fuel to the passage 70 and, as hereinbefore described, ultimately to engine 20.

As should be apparent, suitable temperature responsive means may be provided in order to slightly open throttle valve 16 during cold engine idle operation in order to thereby assist in sustaining such cold engine idle operation and preclude rough engine operation.

Referring to FIG. 1 it can be seen that in the depicted embodiment the diffuser or discharge nozzle means 94 is comprised of a plurality of generally radially extending circumferentially spaced discharge ports or apertures 102 and that preferably at least one, as at 160, of the apertures or ports 102 is situated as to be generally aligned with the path of flow from the sonic nozzle or restrictor means 78. That is, all apertures or discharge ports 102, except for the one identified at 160, are illustrated as having their respective axis generally contained as within a common plane normal to the axis of the induction passage means 14. However, as indicated in FIG. 1 discharge port or aperture 160 is generally aligned with the nozzle 78 axis which, in the preferred embodiment, is inclined (and not normal) to the axis of the induction passage 14.

It has been discovered that good engine and vehicle performance can be obtained even though the spacing as between discharge ports 102 be varied and even though the angle of discharge of such ports 102 (or any one of them) be varied. However, it has also been discovered that generally better engine performance occurs when discharge port or aperture means such as depicted at 160 is provided.

Figure 7:
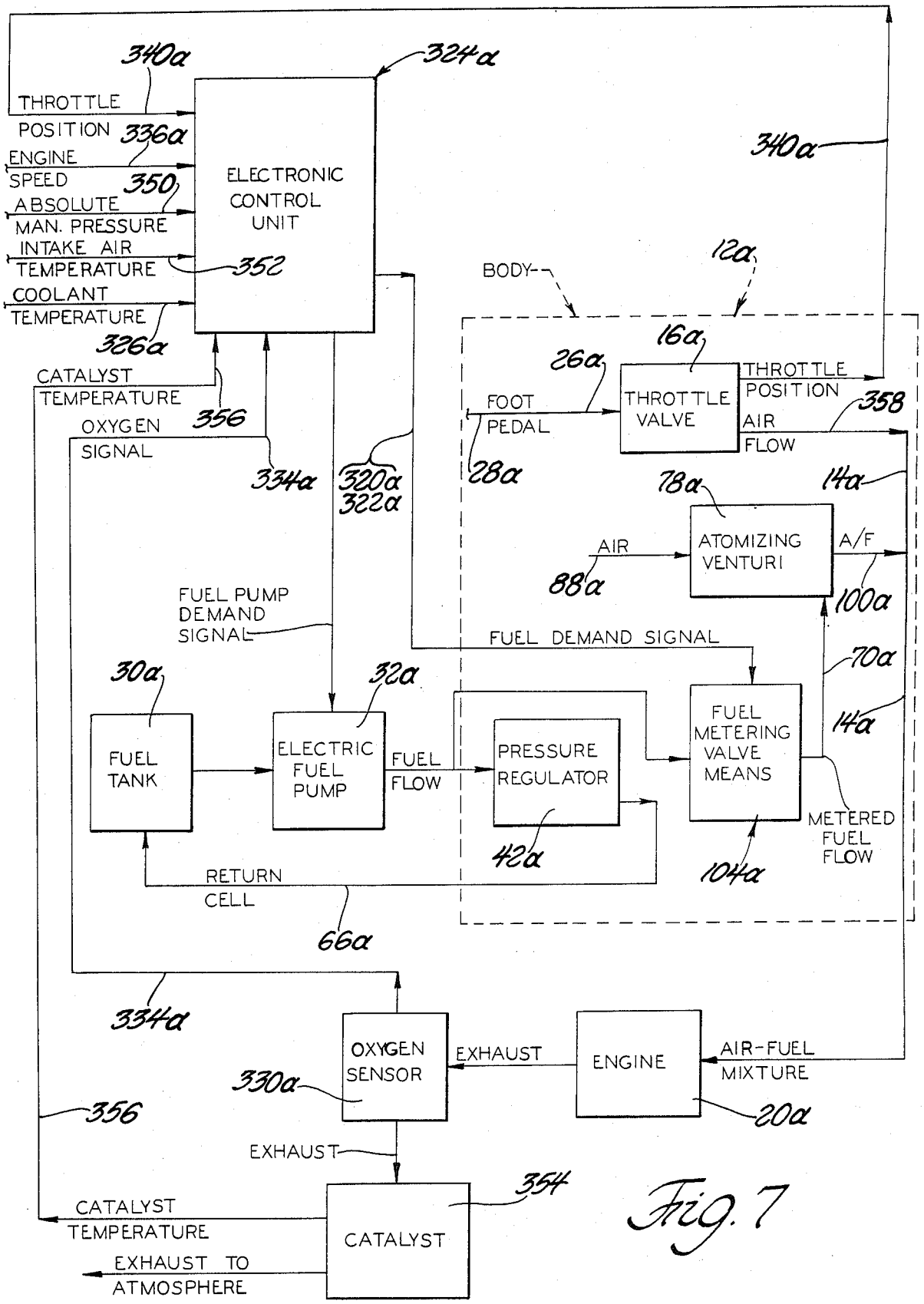
FIG. 7 is a block diagram of an entire fuel metering system as may be applied to or employed in combination with the fuel injection apparatus of FIGS. 1 and 2.

FIG. 7 illustrates in general block diagram the structure of FIG. 1 along with other contemplated operating parameter and indicia sensing means for creating related inputs to the control means which, as generally identified in FIG. 7, may be an electronic control unit. For ease of reference, elements in FIG. 7 which correspond to those of FIG. 1 are identified with like reference numbers provided with a suffix "a".

As generally depicted in FIG. 7 the electronic control or logic means **324*a* is illustrated as receiving input signals, as through suitable transducer means, reflective and indicative of various engine operating parameters and indicia of engine operation. For example, it is contemplated that the electronic logic or control means 324*a* would receive, as inputs, signals of the position of the throttle valve means 16*a* as via transducer or transmission means 340*a*; the magnitude of the engine speeds as by transducer or transmission means 336*a*; the magnitude of the absolute pressure within the engine intake manifold 22 as by transducer or transmission means 350; the temperature of the air at the inlet of the induction system as by transducer or transmission means 352; the magnitude of the engine 20*a* coolant system temperature as via transducer or transmission means 326*a*; the magnitude of the engine exhaust catalyst 354 temperature as by transducer or transmission means 356; and the percentage of oxygen (or other monitored constituents) in the engine exhaust as by transducer or transmission means 334*a***.

In considering FIGS. 1, 2 and 7, it can be seen that the electronic control means 122*a*, upon receiving the various input signals, creates a first output signal as along conductor means 320*a* and 322*a* thereby energizing fuel metering valving means 104*a*. If the operator should open throttle valve means 16*a*, as through pedal 28*a* and linkage or transmission means 26*a*, the new position thereof is conveyed to the control means 324*a* and an additional rate of air flow 358 is permitted into the induction passage means 14*a* as to become commingled with the motive fluid being discharged by the nozzle means 94.

In any event, the fuel-air mixture is introduced into the engine 20*a* (as via intake manifold means 22) and upon being ignited and performing its work is emitted as exhaust. An oxygen or other gas sensor, or the like, 330*a* monitors the engine exhaust gases and in accordance therewith creates an output signal via transducer means 334*a* to indicate whether the exhaust gases are overly rich, in terms of fuel, too lean, in terms of fuel, or exactly the proper ratio. The electronic control means, depending upon the nature of the signal received from the gas sensor 330*a*, produces an output signal as via conductor means 320*a* and 322*a* for either continuing the same duty cycle of fuel metering valve means 104*a* or altering such as to obtain a corrected duty cycle and corresponding altered rate of metered fuel flow. Generally, each of such input signals (varying either singly or collectively) to the electronic control means (except such as will be noted to the contrary) will, in turn, cause the electronic control means 324*a* to produce an appropriate signal to the fuel metering valve assembly 104*a*.

As is also best seen in FIG. 7, a fuel supply or tank 30*a* supplies fuel to the inlet of a fuel pump 32*a* (which may be electrically driven and actually be physically located within the fuel tank means 30*a*) which supplies unmetered fuel to suitable pressure regulator means 42*a* which is generally in parallel with fuel metering valving assembly 104*a*. Return conduit means 66*a* serves to return excess fuel as to the inlet of pump means 32*a* or, as depicted, to the fuel tank means 30*a*. Fuel, unmetered, at a regulated pressure is delivered via conduit means 36 to the upstream side of the effective fuel metering orifice as determined by orifice means 72 and coacting valving member 74.

It is contemplated that certain fuel metering functions may be or will be performed in an open loop manner as a fuel schedule which, in turn, is a function of one or more input signals to the control means 324*a*. For example, it is contemplated that acceleration fuel could be supplied and metered by the fuel metering valving assembly 104*a* as a function of the position of throttle valve means 16*a* and the rate of change of position of such throttle valve means 16*a* while the engine cranking or starting fuel and cold engine operation fuel metering schedule would be a function of engine temperature, engine speed and intake manifold pressure. Further, it is contemplated that open loop scheduling of metered fuel flow would be or could be employed during catalytic converter warm-up and for maximum engine power as at wide open throttle conditions as well as being employed during and under any other conditions considered necessary or desirable.

Although various inlet ports through the extension 124 (FIGS. 2 and 4) are possible, it is preferred to provide inlet ports 200 and 202 as large as practicably possible.

It is further contemplated that the metering assembly 104 may be so situated within the related induction structure as to have a substantial portion of the housing 120 in contact with liquid fuel as to thereby employ such fuel to serve as a heat sink. In such a situation, of course, the lower end (as viewed in FIG. 2) of the bobbin-coil assembly 138–146 would be exposed to such fuel. However, the fuel would not flow upwardly further than the distances determined by seals 134, 168 and 218.

Further, it should be made clear that the valving assembly 104 need not be employed in combination with an overall induction system as depicted in, for example, FIG. 1. The valving assembly 104 may be employed in combination with any other fuel-air engine induction system as, for example, where fuel is directly metered to each engine combustion chamber (this being done for example, by injecting the fuel into the air stream at or near the respective engine intake valves) or by metering fuel as into or near a main engine throttle body which serves to control the flow of motive fluid to all of the engine combustion chambers.

It should also be made clear that by providing the spring 220 as to exert its resilient force upon the ball valve at a point or area below the geometric center of rotation of the ball valve, or relatively closer to the ball valve seat that the ball valve 222 thereby has a greater propensity to align itself with the sealing area of the seat surface 206 resulting in enhanced sealing characteristics. It is, of course, contemplated that the resilient means thusly received by valve member 222 may actually comprise means other than mechanical springs and may comprise more than one of such means as well as more than one of such mechanical springs.

Although only a preferred embodiment and selected modifications of the invention have been disclosed and described, it is apparent that other embodiments and modifications of the invention are possible within the scope of the appended claims.

What is claimed is:

1. A valving assembly for variably restricting fluid flow, comprising housing means, bobbin means situated in said housing means, said bobbin means comprising a generally medially situated tubular body portion, electrical field coil means carried by said bobbin means, pole-piece means situated generally within said tubular body portion, a valve seat member, fluid flow passage means formed through said valve seat member, said pole-piece means comprising a pole-piece face portion, a valve member situated generally between said pole-piece face portion and said valve seat member, said valve member comprising at least a portion thereof of generally spherical configuration, said portion of generally spherical configuration having a center of curvature, wherein said portion of generally spherical configuration is directed generally toward said valve seat member, and resilient means normally resiliently urging said valve member toward a direction whereby said portion of generally spherical configuration moves toward operative seating engagement with said valve seat member as to thereby terminate flow through said fluid flow passage means, a recess formed in said valve member, said recess extending through a side of said valve member and through said center of curvature, said recess terminating in an internal reaction end surface means disposed generally on a side of said center of curvature opposite to where said recess extends through the side of said valve member, at least a portion of said resilient means being received within said recess and operatively abutting against said internal reaction end surface means, said valve member comprising armature means of said electrical coil and said pole-piece means.

2. A valving assembly according to claim 1 wherein said valve member comprises a ball valve body.

3. A valving assembly according to claim 1 and further comprising a second recess formed in said pole-piece means, and wherein said resilient means is carried at least partly within said second recess.

4. A valving assembly according to claim 1 wherein said pole-piece face portion comprises a conical configuration.

5. A valving assembly according to claim 1 wherein said valve seat member comprises a valve seating surface, and wherein said seating surface comprises a conical configuration.

6. A valving assembly according to claim 1 wherein said valve seat member is axially adjustable towards and away from said pole-piece face portion.

7. In combination, a combustion engine, fuel metering apparatus for supplying metered rates of fuel flow to said engine, said fuel metering apparatus comprising body means, induction passage means formed through said body means for supplying motive fluid to said engine, throttle valve means situated in said induction passage means for variably controlling the rate of flow of air through said induction passage means, fuel-air mixture discharge means situtated in said induction passage means downstream of said throttle valve means, air passage means communicating between a source of air and said fuel-air mixture discharge means, and fuel metering means for metering liquid fuel under superatmospheric pressure in response to engine demands and indicia of engine operation, said fuel metering means for metering liquid fuel comprising a duty-cycle type fuel metering solenoid assembly, said fuel metering solenoid assembly comprising a ball-armature valve member, a recess formed in said ball-armature valve member, said recess extending through a side of said ball-armature valve member and through the center of curvature thereof, said recess terminating in an internal reaction end surface means disposed generally on a side of said center of curvature opposite to where said recess extends through the side of said ball-armature valve member, resilient means at least partly received by said recess in said ball-armature valve member and operatively engaging said internal reaction surface means for resiliently urging said ball-armature valve member toward a closed position, and a field winding, said field winding being intermittently energizable during metering of said liquid fuel as to cause said ball-armature valve to move toward and away from said closed position with respect to an associated valve seat member and thereby result in an average rate of flow of fuel past said ball-armature valve member which constitutes the then metered rate of liquid fuel flow, said liquid fuel when metered by said fuel metering means being discharged into said air passage means at an area thereof downstream of said source of air and upstream of said fuel-air mixture discharge means.

8. The combination of claim 7 wherein said air passage means comprises flow restriction means, and wherein said flow restriction means is calibrated as to provide for sonic flow therethrough for at least certain conditions of engine operation.

9. The combination of claim 7 wherein said fuel metering solenoid assembly further comprises generally cylindrical core means, a generally axially extending opening formed in said core means, and wherein said resilient means is at least partly carried by said opening.

10. The combination of claim 9 and further comprising spring seat adjustment means, said adjustment means being effective to selectively establish the resilient preload on said resilient means.

* * * * *